US006879262B1

(12) United States Patent
Tödteberg et al.

(10) Patent No.: US 6,879,262 B1
(45) Date of Patent: Apr. 12, 2005

(54) CONTROL DEVICE FOR A LABORATORY CENTRIFUGE

(75) Inventors: Eckhard Tödteberg, Osterode (DE); Michael Bender, Osterode (DE)

(73) Assignee: Sigma Laborzentrifugen GmbH, Osterode (DE)

( * ) Notice: Subject to any disclaimer, the term of this patent is extended or adjusted under 35 U.S.C. 154(b) by 0 days.

(21) Appl. No.: 09/462,573

(22) PCT Filed: Sep. 7, 1997

(86) PCT No.: PCT/EP97/04855

§ 371 (c)(1),
(2), (4) Date: Jan. 10, 2000

(87) PCT Pub. No.: WO99/02270

PCT Pub. Date: Jan. 21, 1999

(30) Foreign Application Priority Data

Jul. 10, 1997 (DE) ..... 297 12 121 U

(51) Int. Cl.[7] ..... G08B 21/00

(52) U.S. Cl. ..... 340/679; 340/680; 340/686.3; 340/691.1; 340/691.6; 340/692; 340/693.1; 345/771; 345/156

(58) Field of Search ..... 340/679, 680, 340/686.3, 691.1, 691.6, 692, 693.1; 345/771, 156

(56) References Cited

U.S. PATENT DOCUMENTS 3,982,895 A * 9/1976 Amos et al. ..... 436/63
4,214,179 A * 7/1980 Jacobson et al. ..... 310/68
4,244,513 A * 1/1981 Fayer et al. ..... 494/10
4,491,019 A * 1/1985 Wicki et al. ..... 73/457
4,972,110 A * 11/1990 Gorodissky et al. ..... 310/68
5,496,254 A * 3/1996 Keller et al. ..... 494/7
5,738,622 A * 4/1998 Niinai et al. ..... 494/7
5,857,955 A * 1/1999 Phillips et al. ..... 494/5
5,916,288 A * 6/1999 Hartman ..... 340/461

FOREIGN PATENT DOCUMENTS

EP 0157373 A2 10/1985 ..... H01H/25/06
EP 0344453 A2 12/1989 ..... B04B/13/00
EP 0347686 A1 12/1989 ..... H03J/1/16
EP 0780754 A1 6/1997 ..... G05G/13/02
GB 2170626 A 8/1986 ..... G06M/3/02

* cited by examiner

*Primary Examiner*—Jeffery Hofsass
*Assistant Examiner*—Daniel Previl
(74) *Attorney, Agent, or Firm*—Synnestvedt & Lechner LLP

(57) ABSTRACT

A control device for controlling operating parameters and control functions for the operation of a laboratory centrifuge. The control device has a panel for displaying a visual representation of at least a part of the operating parameters and control functions such as speed of rotation, acceleration temperature, etc. A control switch sets the operating parameters and control functions, this switch being capable of at least two independent movements—a first movement including a rotation about an axis, the second one a displacement along the axis. One of these switch movement, e.g., rotation, provides for the selection and change in setting of one of the operating parameters and control functions, and another of the switch movement, e.g., displacement, provides for acceptance of the selection and acceptance of the setting.

17 Claims, 5 Drawing Sheets

FIG.9

| NO | SPEED | RCA | TIME | TEMP | ACC | DEC | ROT |
|---|---|---|---|---|---|---|---|
| 5 | | | | | | | |
| 6 | | | | | | | |
| 7 | 3460 | 1927 | 0:02:00 | 20 | 9 | 9 | 09100 |
| 8 | | | | | | | |
| 9 | | | | | | | |
| - | 3460 | 1927 | 0:02:00 | 20 | 9 | 9 | 09100 |

9

FIG.10

PROGRAM 7

LOAD SAVE DELETE CANCEL

9

FIG.11

| NO | ROTOR | BUCKET | SPEED | RCA | RMAX | RMIN |
|---|---|---|---|---|---|---|
| 1 | 09100 | 09101 | 6200 | 6189 | 144 | 62 |
| 2 | 11140 | 13115 | 5500 | 5411 | 160 | 71 |
| 3 | 11140 | 13127 | 5500 | 5648 | 167 | 80 |
| 4 | 11140 | 13200 | 5500 | 5513 | 163 | 71 |
| 5 | 11140 | 13201 | 5500 | 5614 | 166 | 64 |
| 6 | 11150 | 13215 | 5100 | 5292 | 182 | 88 |

9

CONTROL DEVICE FOR A LABORATORY CENTRIFUGE

BACKGROUND

The invention relates to a control device for a laboratory centrifuge, and more particularly to a laboratory centrifuge having a control panel which includes a display panel and switching devices for the operation of the centrifuge.

Laboratory centrifuges are used inter alia in the medicinal-pharmaceutical field for the treatment of mixtures of substances by centrifuging, if necessary in accordance with a particular treatment time and a particular temperature curve. Such centrifuges consist essentially of a housing which can be closed by a lid, and within which is arranged a replaceable rotor whose peripheral portion is arranged to receive receptacles which are likewise replaceable, and in which the mixtures of substances to be treated are placed. The rotor is connected to an electrical drive and the total system consisting of rotor and electric motor is arranged to be able to oscillate within the housing.

In dependence upon the inserted rotor as well as in dependence on the receptacles inserted into the rotor, different maximum speeds of rotation apply, which must be adhered to by monitoring the operation of the centrifuge. Additionally, in dependence upon the mixtures of substances to be treated, further requirements arise, for example in relation to the treatment time and the treatment temperature, which in the same way must be monitored. Consequently, data specific to the rotor, the receptacles and the mixtures of substances are entered into appropriate storage media of the control device of the laboratory centrifuge, from which, depending upon the absolute volume of the data to be entered and of the control functions to be activated or to be inactivated, costly setting procedures result, which make necessary a correspondingly equipped control panel for the control device. This is characterized as a consequence by a plurality of switch devices.

Again in dependence upon the complexity of the switching and entry devices for data and functions necessary in this connection, the operation of a laboratory centrifuge turns out to be comparatively complex, in particular its change over, for example to another treatment program, with the result that operating errors cannot be excluded.

A generic control device designed for use with a laboratory centrifuge is known for example from EP 0344453 A2. This is constructed as a microcomputer which is provided with a display panel and an input keyboard as well as further function keys by means of which operating parameters, program runs, etc. can be entered and can be stored in a storage device internal to the computer for the purpose of controlling the operations. The display panel is set up to display various operating functions, particularly to visualize inputted switching processes. For this it is essential that, in order to call up as well as to change, the course of operations of the laboratory centrifuge, namely to produce operating procedures appropriate to different materials to be handled, it is necessary to actuate a relatively large number of function keys, which brings with it the danger of operational errors and in any case a relatively costly training for the operator in order reliably to master the frequently complex setting procedures.

SUMMARY OF THE INVENTION

It is the object of the invention to develop an actuating device specifically for a laboratory centrifuge, for controlling operating parameters and control functions for the operation of the laboratory centrifuge, whose operation in comparison with the illustrated prior art is simpler, faster, error-free and in particular multilingual. This object is achieved with a control device for controlling operating parameters and control functions for the operation of a laboratory centrifuge, the control device including a display panel for displaying a visual representation of at least a part of the operating parameters and control functions. A control switch is provided for setting the operating parameters and control functions. The control switch is capable of at least two independent movements, a first of the movements including a rotation about an axis and a second of the movements including a displacement along the axis. The display panel is configured to display the visually represented operating parameters and control functions in response to movement of the control switch. One of the movements provides for selection and change in setting of one of the operating parameters and controls functions and another of the movements provides for acceptance of the selection and acceptance of the setting.

It is essential to the invention that for the setting of all operating parameters and control functions (collectively referred to herein as "operating commands") just a single control switch is provided, which is set up to execute at least two switch movements which are independent of one another and which is set up for the handling of at least one menu configuration of the display panel of the control panel. The menu field is divided in a manner known per se into message fields which by means of the control switch can be individually selected and activated or inactivated. Thus, in combination with a correspondingly set up clear text guide of the menu, the setting of operating parameters and control functions is intelligible from this alone and in particular does not necessitate any complicated and lengthy instructions. The switch movements can be set up for example so that the one switch movement is for choice and setting of the procedure and the other switch movement is for the changeover or acceptance of the particular switch function. Because the display panel makes each switch movement visually clear directly, success or failure of switch movements is recognizable without difficulty by the user, so that in this way an aid to the avoidance of operating errors has been introduced. As the control switch, one can use basically any switch which is set up to be able to execute at least two switch movements independently of one another, and whose control-technical changeover has an effect in subsidiary switching circuits. The control switch is according to the invention a switch which on the one hand is rotatable about its axis and which simultaneously is displaceable in the direction of this axis. Preferably, the said rotational movement is an incremental or digitized rotational movement, so that each rotational step can have a selectable change of parameter associated therewith. The association of switching functions with these switch movements is arbitrary and can be chosen according to what is considered most expedient.

According to the invention, the association between switch movements and switch functions is connected with a menu guide. Thus, the one of the two switch movements can be used basically for selection movements, i.e. for the choice of a particular message field of the menu, whereas the other switch movement can be used for the acceptance or rejection of the chosen message field and of the parameter value set there. The starting of the last-mentioned switch movement can simultaneously be used to change the switch function of the first-mentioned switch movement from a previous selection of a message field to the setting of the parameter associated with this message field.

Further features of the invention can include a control panel comprising the display panel and the control switch, and a plurality of separate switches arranged on the control panel for powering the laboratory centrifuge and for locking a cover of the laboratory centrifuge. Separate switches are provided only for switching on and switching off as well as for the locking of the cover of the housing of the laboratory centrige, consequently for comparatively simple functions. With regard to the available switch functions there is consequently a complete decoupling, in terms of control between those which serve for the setting of operating parameters, programs, control functions and the like and the functions which are directed only to putting the laboratory centrifuge into operation and to bringing its activity to an end.

Examples of the operating parameters and control functions which can be influenced by the control switch of the present invention. There is however no question here of this being a closed list of items, since further functions and control programs can be added, depending upon the treatment program to be carried out.

Further features of the invention include an acoustic signal associated with each change of setting. This makes it apparent that the user of the control device can have any switch movement signaled to him not only optically but possibly also acoustically, so that early attention can be drawn to operating errors.

According to another feature of the invention, the control switch is located in a central position below the display panel. This means that, in spite of the spatial proximity of control switch and display panel, neither for a left-handed or right-handed user is the visibility of the display panel hindered during the actuation of the control switch. This is a preferred arrangement of the control switch, which simultaneously makes possible a simple successful control of the inputted switch functions from the display panel for both left-handed and right-handed operators should remain guaranteed.

The control device of the present invention thus constitutes an operating means for the setting of operational parameters and control functions of a laboratory centrifuge which can be handled extremely simply, which is self-explanatory in terms of its functions on the basis of a menu guide, and which on the basis of the bringing together of all the setting functions into one single control switch in a special way means that one can avoid operational errors.

BRIEF DESCRIPTION OF THE DRAWINGS

The invention will not be described in more detail with reference to the embodiment which is given by way of example and which is shown in the drawings.

FIGS. 2 to 11 show diverse menu configurations controllable by means of the control panel according to the invention.

DETAILED DESCRIPTION

Figure 1:
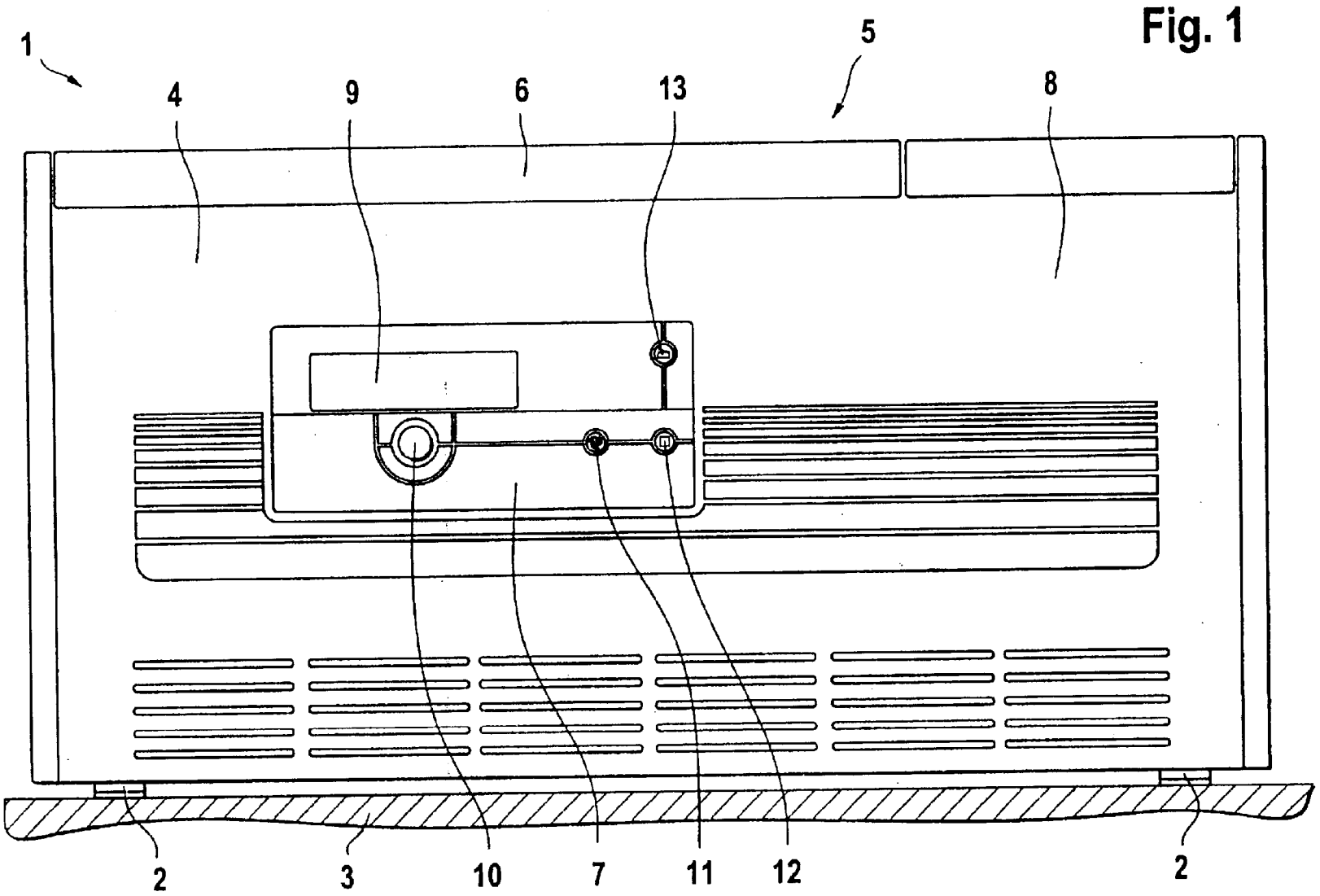
FIG. 1 is a representation of the front-end view of a laboratory centrifuge with control panel according to the invention.

In FIG. 1 the reference numeral 1 indicates a laboratory centrifuge equipped with a control device according to the invention, the centrifuge being supported by means of support feet 2 on a base 3. It consists essentially of an overall rectangular housing 4, whose top 5 is closed off by a cover 6 which is pivotable about a horizontal axis between a closed position as shown in the drawing and an open position.

Within the housing there is located a rotor which is mounted to be rotatable about a vertical axis and which is set up in the peripheral region for the releasable receiving of receptacles. The rotor is rotatably driven by an electric motor. The system of rotor and electric motor is suspended within the housing so as to be able to oscillate, and is in operative connection with a source of energy and with a control device arranged within the housing in a manner which is not shown in the drawings. This control device comprises a control panel 7 which is arranged on the front 8 of the housing 1 as shown in the drawing and whose structure and functions will be described in more detail hereinafter.

In the control panel 7 are integrated a display panel 9, a control switch 10, as well as further switches 11 to 13. The display panel 9 can be an LCD display device for example. The control switch 10, whose functions will be described in more detail hereinafter, is incrementally rotatable about an axis extending perpendicular to the plane of the front 8 of the panel and is simultaneously moveable perpendicular to the plane of the front 8 of the panel, for example being arrestable in at least two positions. Its essential significance is in making it possible to carry out the manual setting of parameters for the operation of the centrifuge, including those of the rotor, the receptacles placed in the rotor, the treatment program etc. The switches 11 to 13 can be formed as sensing keys, with the switches 11, 12 functioning as the "on" switch and "off" switch, and with the switch 13 being a switch controlling the locking and unlocking of the cover 6. Since the operation of the laboratory centrifuge is characterised by comparatively high speeds of rotation of the rotor, a considerable safety risk arises from this in the case of breakdown. This is countered by the use of an appropriate design of the housing 4 as well as of the cover 6, in connection with which the locking circumstances of the cover 6 have a particular significance for example.

It is of importance to the invention that, for the setting of operating parameters for the operation of the centrifuge, only one switch member is provided, namely a control switch 10 which is arranged centrally below the display panel 9 and which is usable in a multifunction manner in association with a menu guide. Thus, the display panel 9 comprises a menu-type area characterised by individual message fields, with the message fields being selectively controllable by actuation of the control switch 10 and wherein the message fields are associated each with defined functions and parameters for the operation for the centrifuge. The rotational movement of the control switch 10 has two functions associated therewith, namely, on the one hand the choice of a specific message field of the display panel 9 and the choice of a particular value of the selected parameter, and on the other hand the choice of a specific function within the range of options associated with the message field. The changing over between these two functions of the control switch is effected by a movement of the switch by the user initiated in its axial direction. The meaning of all the message fields is characterised by a clear text designation, so that the meaning is self-evident for the user and no special explanations are needed. In addition to the setting of operational parameters the display panel 9 also serves to signal fault occurrences as well as current operational conditions of the centrifuge. Likewise, by means of the control switch 10, these functions can be called up on the display panel, so that, in the event of need, they can have an influence on the operation of the centrifuge in dependence upon the information obtained in this way. Consequently, in the same way, safety functions are integrated into the aforesaid control device. This is consequently a dialogue-dependent system which is self-explanatory, which brings with it a significant simplification of the operation of the centrifuge and, basically, is suited to the elimination of operational errors, because these are recognised and are signalled in an optical and/or acoustic manner.

With reference to the menu configurations corresponding to FIGS. 2 to 13, which are to be understood as being shown only by way ofexample, a number of control functions associated with the control switch 10 will now be explained.

Figure 2:
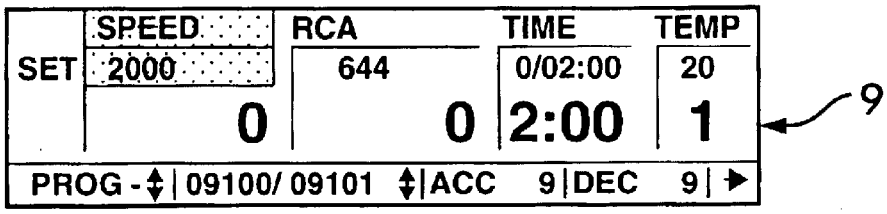
Figure 3:
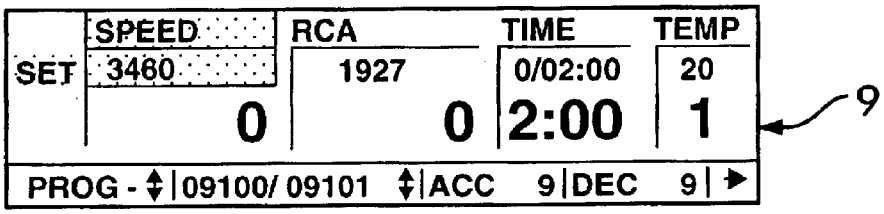
Figure 4:
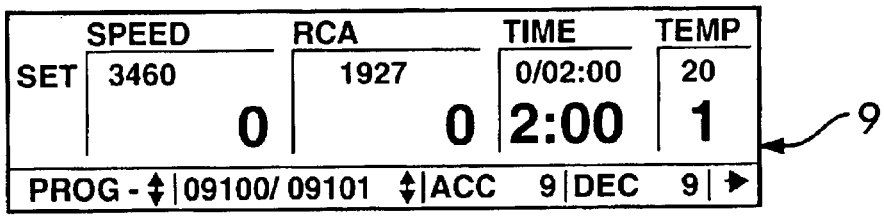

FIGS. 2 to 4 show a basic menu, which shows the message fields, SPEED (of rotation), RCA (relative centrifugal acceleration), TIME, TEMP (temperature), PROG (program), ACC (acceleration), DEC (deceleration/brake) etc. as well as the message field SET. The respective set values associated with these parameters are given by a suitable dimension figure within these message fields. It is important that by rotation of the control switch 10 the message fields are chosen (selected) successively, and that by pressing the control switch in its axial direction the particular selected message field is confirmed (accepted) thereafter by renewed rotation of the control switch the value (setting) of the particular parameter is incrementally changed. When the desired value has been reached, the set value (setting) is accepted by renewed axial pushing of the control switch. In the illustrated embodiment, the message field SPEED is first selected (FIG. 2), then is accepted by pressing the control switch, after which the speed of rotation is changed from the former Figures 2000 to 3460 (FIG. 3) and then is confirmed by again pressing the control switch (FIG. 4). The parameters appearing in bold represent actual measured values. The confirmed field SET signals the acceptance of the setting process.

Figure 5:
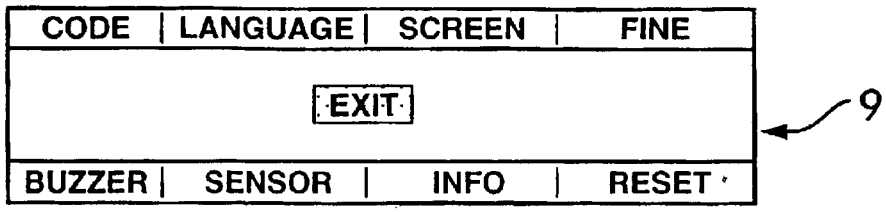
Figure 6:
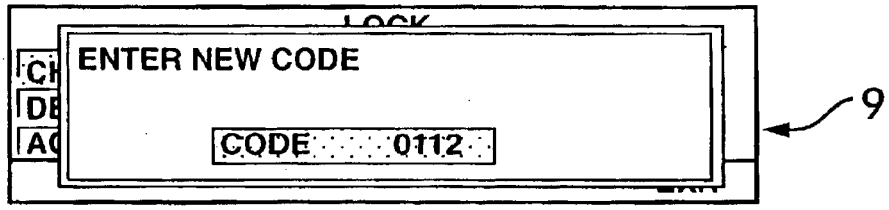
Figure 7:
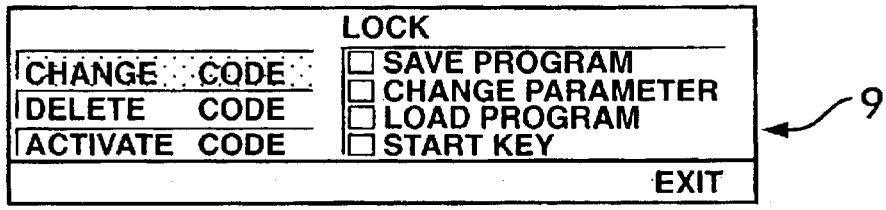
Figure 8:
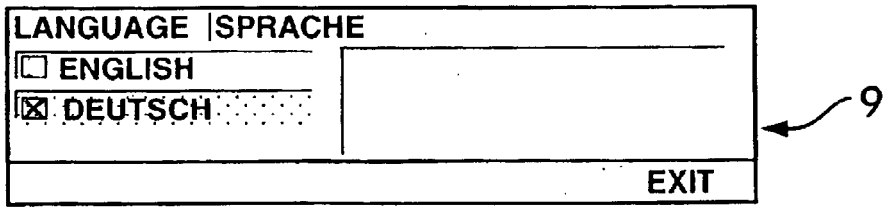

FIG. 5 shows a further menu, which shows the message fields, CODE, LANGUAGE, SCREEN, FINE, BUZZER, SENSOR, INFO, RESET, which again can be chosen in succession by means of the control switch and can be confirmed and activated by pushing the switch. The control functions characterized by the message fields are easily understandable and this makes the dialogue with the actuating device for the purpose of changing these control functions—e.g. the language or an increase in size of the display (zoom function)—extraordinarily simple. By means of the message field PROG, programs for the treatment of materials by centrifuging can be called up, these programs including complete sets of data which are composed of the values of the speed of rotation, the relative centrifugal acceleration, the time, the temperature, the acceleration, the braking, the type of rotor, the inserted containers, as well as the radial values of the rotor.

FIGS. 9 and 11 show representative illustrations of such sets of data stored under a program number and which can be called up under the number of a specific program. These sets of data can be compiled as appropriate and simplify the setting of the parameters.

Figure 12:
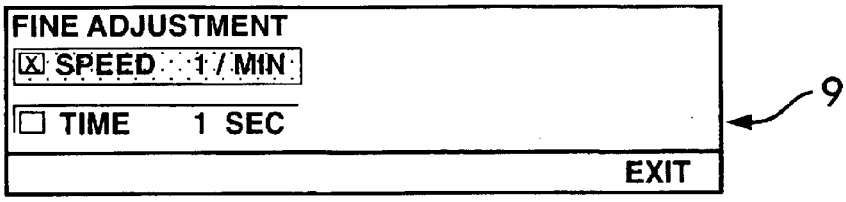
FIGS. 12 to 13 show a number of control functions associated with the control switch.

FIG. 12 shows, purely by way of example, among other items the parameter "FINE ADJUSTMENT", by means of which, in connection with the incremental rotational movement of the control switch 10, the parameter change associated with each step can be varied, in the sense of larger or smaller steps.

Figure 13:
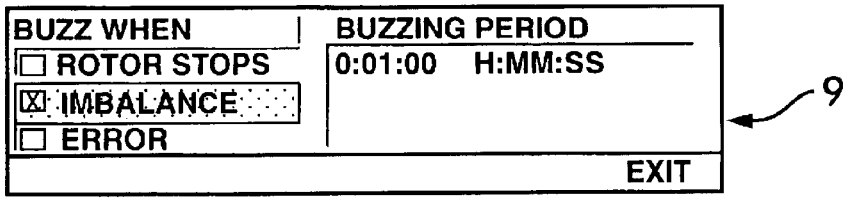

FIG. 13 shows a menu field according to which the user can define under what conditions an acoustic signal, here from a buzzer, is generated. Purely by way of example, this is provided for in this case if the rotor stops, if an imbalance occurs, in which case one can even differentiate between a static and a dynamic imbalance, and in the case of an operator error. In addition to this, the buzzing period can be set.

Operator errors can arise for example if the speed of rotation at which a rotor inserted into the centrifuge should be driven lies above its highest permissible speed of rotation. The latter depends upon the particular type of rotor, however also upon the type of receptacles containing substances to be subjected to centrifugal treatment which are inserted in the rotor.

The concrete functional relationship to the above-mentioned message fields is to be understood as only being by way of example. Any number of menus set up with respective message fields can be provided, which can be activated in sequence by multiple pressing of the control switch. It is also possible, in combination with an appropriate design of menu, to provide a coding which makes the changing of the operating parameters of the centrifuge dependent upon the initial entry of a code, so that changing of these operational parameters by unauthorised persons is at least made more difficult.

In the control device for a laboratory centrifuge according to the invention, one thus has an extraordinarily simple, manually controllable actuating and display system, whose functions are directly explained by the menu guide and whose operation is made extraordinarily simple by the concentration of all the switch movements into one control switch 10.

In the claims:

1. A control device for controlling operating parameters and control functions for the operation of a laboratory centrifuge, said control device comprising:

a display panel for displaying a visual representation of at least a part of the operating parameters and control functions;

a control switch for setting the operating parameters and control functions, said control switch being capable of at least two independent movements, a first of said movements comprising a rotation about an axis and a second of said movements comprising a displacement along said axis;

wherein said display panel is configured to display said visually represented operating parameters and control functions in response to movement of said control switch; and wherein one of said movements provides for selection and change in setting of one of the operating parameters and control functions and another of said movements provides for acceptance of said selection and acceptance of said setting.

2. The control device of claim 1, further comprising:

a control panel comprising said display panel and said control switch; and a plurality of separate switches arranged on said control panel for powering the laboratory centrifuge and for locking a cover of the laboratory centrifuge.

3. The control device of claim 2, wherein said operating parameters and control functions comprise speed of rotation, centrifugal acceleration, rotor acceleration, rotor braking, treatment time, treatment programs, signaling of operating errors, and signaling of imbalances and for selecting rotor type, receptacle type and radial values of a rotor.

4. The control device of claim 3, further comprising an acoustic signal associated with each said change of setting.

5. The control device of claim 4, wherein said control switch is positioned substantially centrally below said display panel.

6. The control device of claim 2, further comprising an acoustic signal associated with each said change of setting.

7. The control device of claim 3, wherein said control switch is positioned substantially centrally below said display panel.

8. The control device of claim 6, wherein said control switch is positioned substantially centrally below said display panel.

9. The control device of claim 2, wherein said control switch is positioned substantially centrally below said display panel.

10. The control device of claim 1, wherein said operating parameters and control functions comprise speed of rotation, centrifugal acceleration, rotor acceleration, rotor braking, treatment time, treatment programs, signaling of operating errors, and signaling of imbalances and for selecting rotor type, receptacle type and radial values of a rotor.

11. The control device of claim 10, further comprising an acoustic signal associated with each said change of setting.

12. The control device of claim 10, wherein said control switch is positioned substantially centrally below said display panel.

13. The control device of claim 11, wherein said control switch is positioned substantially centrally below said display panel.

14. The control device of claim 1, further comprising an acoustic signal associated with each said change of setting.

15. The control device of claim 14, wherein said control switch is positioned substantially centrally below said display panel.

16. The control device of claim 1, wherein said control switch is positioned substantially centrally below said display panel.

17. A control device for a laboratory centrifuge, said control device comprising:

a display panel for displaying a visual representation of operating commands for a laboratory centrifuge;

a control switch for setting an operating command, said control switch being capable of at least two independent movements, a first of said movements comprising a rotation about an axis and a second of said movements comprising a displacement along the axis;

wherein said display panel is configured to display at least one menu configuration of operating commands; and wherein one of said movements provides for selection of and also change in setting of said operating command and another of said movements provides for acceptance of said selection and also acceptance of said setting.

* * * * *